US012734638B2

(12) United States Patent
Zhu et al.

(10) Patent No.: US 12,734,638 B2
(45) Date of Patent: Sep. 15, 2026

(54) GROOVES FOR EDGE AND HOT SPOT COMPENSATION IN CHEMICAL MECHANICAL POLISHING

(71) Applicant: Applied Materials, Inc., Santa Clara, CA (US)

(72) Inventors: Zhize Zhu, Cupertino, CA (US); Brian J. Brown, Palo Alto, CA (US); Christopher Heung-Gyun Lee, San Jose, CA (US); Huyen Tran, San Jose, CA (US); Huanbo Zhang, Santa Clara, CA (US); Eric Lau, Santa Clara, CA (US); Ekaterina A. Mikhaylichenko, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 256 days.

(21) Appl. No.: 18/377,615

(22) Filed: Oct. 6, 2023

(65) Prior Publication Data

US 2025/0114901 A1 Apr. 10, 2025

(51) Int. Cl.
*B24B 37/26* (2012.01)
*B24B 37/04* (2012.01)

(52) U.S. Cl.
CPC ..... *B24B 37/26* (2013.01); *B24B 37/042* (2013.01)

(58) Field of Classification Search
CPC ..... B24B 37/26; B24B 37/042
See application file for complete search history.

(56) References Cited

U.S. PATENT DOCUMENTS 5,558,563 A 9/1996 Cote et al.
5,873,769 A 2/1999 Chiou et al.
6,093,651 A * 7/2000 Andideh ..... B24B 37/26 438/692
6,139,406 A 10/2000 Kennedy et al.
6,165,904 A 12/2000 Kim
6,273,806 B1 8/2001 Bennett et al.
(Continued)

FOREIGN PATENT DOCUMENTS

TW 202220050 A 5/2022
TW 202245974 A 12/2022
TW 202332535 A 8/2023

OTHER PUBLICATIONS

Office Action in Taiwanese Appln. No. 113137913, mailed on Aug. 28, 2025, 24 pages (with English summary).

*Primary Examiner* — Binh X Tran
*Assistant Examiner* — Christopher Remavege
(74) *Attorney, Agent, or Firm* — Fish & Richardson P.C.

(57) ABSTRACT

A method for chemical mechanical polishing includes rotating a polishing pad about an axis of rotation, positioning a substrate against the polishing pad, dispensing a polishing liquid onto the polishing pad, and oscillating the substrate laterally across the polishing pad. The polishing pad has a polishing-rate adjustment groove that is concentric with the axis of rotation, and a coolant, a dilutant, or both, is dispensed into the polishing-rate adjustment groove such that a polishing rate is reduced in an annular zone of the polishing pad that is positioned radially inward of the polishing-rate adjustment groove. The annular zone surrounds a central zone of the polishing pad in which a polishing rate is not substantially affected by the coolant, dilutant, or both.

18 Claims, 9 Drawing Sheets

(56) References Cited

U.S. PATENT DOCUMENTS

| | | | | |
|---|---|---|---|---|
| 7,052,374 | B1 | 5/2006 | Lu et al. | |
| 9,782,870 | B2 | 10/2017 | Maruyama et al. | |
| 2007/0135020 | A1 | 6/2007 | Nabeya | |
| 2007/0284338 | A1* | 12/2007 | Matsui | B24B 37/26 438/692 |
| 2008/0311823 | A1 | 12/2008 | Aiyoshizawa et al. | |
| 2009/0170320 | A1* | 7/2009 | Heinrich | H01L 21/32125 438/692 |
| 2010/0151771 | A1 | 6/2010 | Nabeya | |
| 2010/0279435 | A1 | 11/2010 | Xu et al. | |
| 2011/0011833 | A1* | 1/2011 | Goto | G11B 5/8404 451/41 |
| 2016/0101500 | A1* | 4/2016 | Fung | B24B 55/02 451/527 |
| 2017/0232572 | A1 | 8/2017 | Brown | |
| 2017/0232574 | A1* | 8/2017 | Kim | B24B 53/095 451/285 |
| 2017/0274496 | A1 | 9/2017 | Cook et al. | |
| 2018/0264619 | A1 | 9/2018 | Yoshida | |
| 2019/0143476 | A1* | 5/2019 | Wu | B24B 49/02 |
| 2020/0282509 | A1* | 9/2020 | Zhang | B24B 37/005 |
| 2020/0331114 | A1* | 10/2020 | Wu | B24B 37/22 |
| 2020/0331117 | A1 | 10/2020 | Wu et al. | |
| 2021/0154796 | A1 | 5/2021 | Zhang et al. | |
| 2022/0234163 | A1* | 7/2022 | Zhang | H01L 21/30625 |
| 2023/0381913 | A1* | 11/2023 | Kwon | B24B 37/042 |
| 2023/0381914 | A1* | 11/2023 | Huang | H01L 22/20 |

* cited by examiner

GROOVES FOR EDGE AND HOT SPOT COMPENSATION IN CHEMICAL MECHANICAL POLISHING

TECHNICAL FIELD

The present disclosure relates to chemical mechanical polishing of substrates.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non-planar surface. In addition, planarization of the substrate surface is usually required for photolithography.

Chemical mechanical polishing (CMP) is one accepted method of planarization. This planarization method typically requires that the substrate be mounted on a carrier or polishing head. The exposed surface of the substrate is typically placed against a rotating polishing pad. The carrier head provides a controllable load on the substrate to push it against the polishing pad. An abrasive polishing slurry is typically supplied to the surface of the polishing pad.

One issue in polishing is non-uniformity in the polishing rate across the substrate. For example, the edge portion of a substrate can polish at a higher relative to the central portion of the substrate.

SUMMARY

In one aspect a method for chemical mechanical polishing includes rotating a polishing pad about an axis of rotation, positioning a substrate against the polishing pad, dispensing a polishing liquid onto the polishing pad, and dispensing a coolant, a dilutant, or both, into a polishing-rate adjustment groove that is concentric with the axis of rotation such that a polishing rate is reduced in an annular zone of the polishing pad that is positioned radially inward of the polishing-rate adjustment groove. The annular zone surrounds a central zone of the polishing pad in which a polishing rate is not substantially affected by the coolant, dilutant, or both. The substrate is oscillated laterally across the polishing pad such that for a first duration a central portion of the substrate and an edge portion of the substrate are positioned over the central zone of the polishing pad such that the central portion of the substrate and the edge portion of the substrate are polished for the first duration by the central zone of the polishing pad, and for a second duration holding the central portion of the substrate is positioned over the central zone of the polishing pad and an angularly extending section of the edge portion of the substrate is positioned over the annular zone such that the central portion of the substrate is polished for the second duration by the central zone of the polishing pad and the edge portion of the substrate is polished for the second duration by both the central zone of the polishing pad and the annular zone so as to reduce a polishing rate of the edge portion.

In another aspect, a polishing system includes a rotatable platen to support a polishing pad that has a polishing-rate adjustment groove that is concentric with an axis of rotation of the platen, a first dispenser to deliver a polishing liquid onto the polishing pad, a second dispenser to deliver a coolant, a dilutant, or both, into the polishing-rate adjustment groove such that a polishing rate is reduced in an annular zone of the polishing pad that is positioned radially inward of the polishing-rate adjustment groove, where the annular zone surrounds a central zone of the polishing pad in which a polishing rate is not substantially affected by the coolant, dilutant, or both, a carrier head to hold a substrate against the polishing pad, the carrier head laterally movable across the polishing pad, an actuator to move the carrier head; and a controller coupled to the actuator. The controller is configured to cause the actuator to oscillate the carrier head and substrate laterally across the polishing pad such that for a first duration cause the actuator to position a central portion of the substrate and an edge portion of the substrate over the central zone of the polishing pad such that the central portion of the substrate and the edge portion of the substrate are polished for the first duration by the central zone of the polishing pad, and for a second duration cause the actuator to position the central portion of the substrate over the central zone of the polishing pad and an angularly extending section of the edge portion of the substrate over the annular zone such that the central portion of the substrate is polished for the second duration by the central zone of the polishing pad and the edge portion of the substrate is polished for the second duration by both the central zone of the polishing pad and the annular zone so as to reduce a polishing rate of the edge portion.

In another aspect a method for chemical mechanical polishing includes rotating a polishing pad about an axis of rotation, positioning a substrate against the polishing pad, dispensing a polishing liquid onto the polishing pad, and dispensing a coolant, a dilutant, or both, on the polishing pad at a position that is radially inward of but near a polishing-rate adjustment groove that is concentric with the axis of rotation such that a polishing rate is reduced in an annular zone of the polishing pad that is positioned radially inward of the polishing-rate adjustment groove. The annular zone surrounds a central zone of the polishing pad in which a polishing rate is not substantially affected by the coolant, dilutant, or both. The polishing-rate adjustment groove is wider than slurry distribution grooves in the central portion of the polishing pad. The substrate is oscillated laterally across the polishing pad such that for a first duration a central portion of the substrate and an edge portion of the substrate are positioned over the central zone of the polishing pad such that the central portion of the substrate and the edge portion of the substrate are polished for the first duration by the central zone of the polishing pad, and for a second duration holding the central portion of the substrate is positioned over the central zone of the polishing pad and an angularly extending section of the edge portion of the substrate is positioned over the annular zone such that the central portion of the substrate is polished for the second duration by the central zone of the polishing pad and the edge portion of the substrate is polished for the second duration by both the central zone of the polishing pad and the annular zone so as to reduce a polishing rate of the edge portion.

In another aspect, a polishing system includes a rotatable platen to support a polishing pad that has a polishing-rate adjustment groove that is concentric with an axis of rotation of the platen, a first dispenser to deliver a polishing liquid onto the polishing pad, a second dispenser to deliver a coolant, a dilutant, or both, onto the polishing pad at a position that is radially inward of but near the polishing-rate adjustment groove such that a polishing rate is reduced in an annular zone of the polishing pad that is positioned radially inward of the polishing-rate adjustment groove, where the annular zone surrounds a central zone of the polishing pad in which a polishing rate is not substantially affected by the coolant, dilutant, or both, a carrier head to hold a substrate against the polishing pad, the carrier head laterally movable across the polishing pad, an actuator to move the carrier head; and a controller coupled to the actuator. The controller is configured to cause the actuator to oscillate the carrier head and substrate laterally across the polishing pad such that for a first duration cause the actuator to position a central portion of the substrate and an edge portion of the substrate over the central zone of the polishing pad such that the central portion of the substrate and the edge portion of the substrate are polished for the first duration by the central zone of the polishing pad, and for a second duration cause the actuator to position the central portion of the substrate over the central zone of the polishing pad and an angularly extending section of the edge portion of the substrate over the annular zone such that the central portion of the substrate is polished for the second duration by the central zone of the polishing pad and the edge portion of the substrate is polished for the second duration by both the central zone of the polishing pad and the annular zone so as to reduce a polishing rate of the edge portion.

Implementations may optionally include, but are not limited to, one or more of the following advantages. Radial polishing non-uniformity, e.g., caused by different polishing rates at different portions of the substrate, can be controlled and corrected. For example, controlling the position of the substrate relative to a region of colder polishing liquid, diluted polishing liquid, or softer polishing pad, can provide edge-correction. Additionally, there is a minimal impact to throughput because the adjustment to polishing can be performed in the polishing station rather than as part of a separate module. Polishing "hot spots," e.g., limited angular regions of the edge of the substrate which are overpolished, can be reduced.

The details of one or more implementations are set forth in the accompanying drawings and the description below. Other aspects, features, and advantages will be apparent from the description and drawings, and from the claims.

BRIEF DESCRIPTION OF THE DRAWINGS

Like reference numbers and designations in the various drawings indicate like elements.

DETAILED DESCRIPTION

As noted above, when a substrate is polished by a polishing pad, the edge portion of the substrate can polish at a higher rate than a central portion of the substrate, resulting in a non-uniformly polished substrate. Moreover, polishing "hot spots," e.g., limited angular regions of the edge of the substrate which are overpolished, can occur.

However, several techniques can be used to reduce the polishing rate at the substrate edge and/or reduce polishing hot spots. These techniques can be used individually, or in combination.

In one aspect, either a cold liquid or a dilutant can be dispensed into a polishing rate adjustment groove, and the substrate can be positioned with the edge adjacent the polishing rate adjustment groove. The old liquid or dilutant can flow from the polishing rate adjustment groove under the edge portion of the substrate, thus reducing the polishing rate at the substrate edge.

In another aspect, an outer annular portion of the polishing pad can be replaced by a material that is softer and has a lower polishing rate than the polishing material in the central portion of the polishing pad. The substrate can be positioned with the edge over this annular region to reduce the polishing rate at the substrate edge.

In yet another aspect, grooves can be laid on the polishing pad that will preferentially channel the polishing liquid away from an outer annular region of the polishing pad. The substrate can be positioned with the edge over this annular region to reduce the polishing rate at the substrate edge.

In still another aspect, a retaining ring with a high density of slurry distribution channels can be used for polishing of a substrate that has a high edge polishing rate. The slurry distribution channels can be configured to preferentially channel the polishing liquid away from the substrate. This can reduce the polishing rate at the substrate edge.

Figure 1:
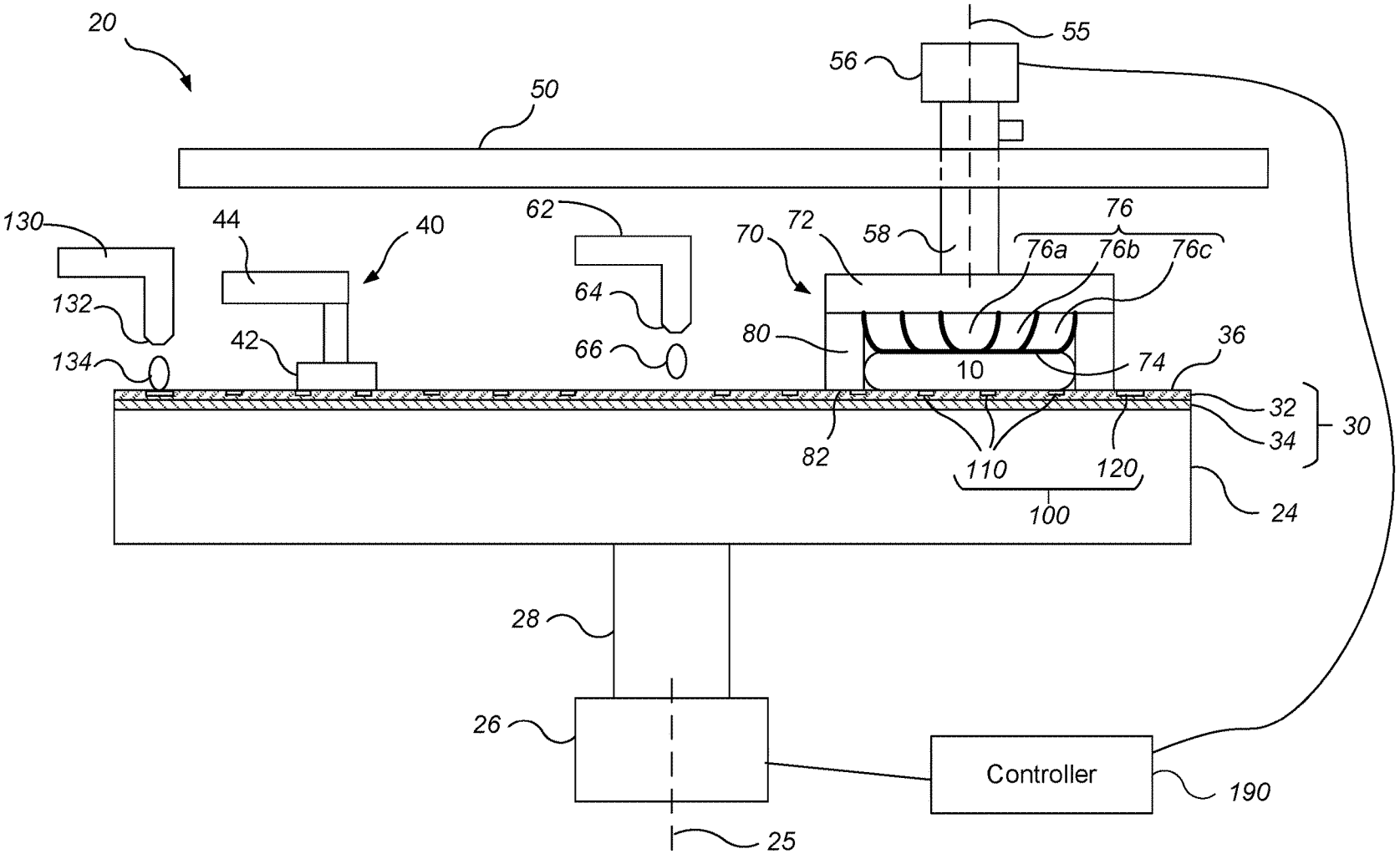
FIG. 1 is a schematic cross-sectional view of a chemical mechanical polishing system with a polishing pad having a polishing rate adjustment groove.

FIG. 1 illustrates an example of a polishing station of a chemical mechanical polishing system 20. The polishing system 20 includes a rotatable disk-shaped platen 24 on which a polishing pad 30 is situated. The platen 24 is operable to rotate about an axis 25. For example, a motor 26 can turn a drive shaft 28 to rotate the platen 24. The polishing pad 30 can be a two-layer polishing pad with an outer polishing layer 32 and a softer backing layer 34. The outer polishing layer 32 has a polishing surface 36.

A plurality of grooves 100 can be formed in the polishing surface 36. In some implementations, the plurality of grooves 100 include both a plurality of polishing liquid distribution grooves 110 and a polishing rate adjustment groove 120. In some implementations, the plurality of grooves 100 include just polishing liquid distribution grooves 110.

The polishing liquid distribution grooves 110 can be annular grooves, e.g., circular grooves, and can be concentric with the center of the polishing pad 30, e.g., with the axis of rotation 25. Alternatively, the polishing liquid distribution grooves 110 can have another pattern, e.g., rectangular cross-hatch, triangular cross-hatch, etc. The polishing liquid distribution grooves 110 can have a width between about 0.015 and 0.04 inches (between 0.381 and 1.016 mm), such as 0.20 inches, and a pitch between about 0.09 and 0.24 inches, such as 0.12 inches. The polishing liquid distribution grooves 110 can be uniformly spaced across the polishing pad 30.

The polishing system 20 can include a supply arm or a combined supply-rinse arm 62 having a port 64 to dispense a polishing liquid 66, such as an abrasive slurry, onto the polishing pad 30. The port 64 can be positioned near the axis of rotation 25 such that centrifugal force carries the polishing liquid outward across the polishing surface 36.

The polishing system 20 can include a pad conditioner apparatus 40 with a conditioning disk 42 to maintain the surface roughness of the polishing surface 36 of the polishing pad 30. The conditioning disk 42 can be positioned at the end of an arm 44 that can swing so as to sweep the disk 42 radially across the polishing pad 30.

A carrier head 70 is operable to hold a substrate 10 against the polishing pad 30. The carrier head 70 is suspended from a support structure 50, e.g., a carousel or a track, and is connected by a drive shaft 58 to a carrier head rotation motor 56 so that the carrier head can rotate about an axis 55. Optionally, the carrier head 70 can oscillate laterally, e.g., on sliders on the carousel, by movement along the track, or by rotational oscillation of the carousel itself.

The carrier head 70 includes a housing 72, and a flexible membrane 74 that defines a plurality of pressurizable chambers 76*a*, 76*b*, 76*c*, and a retaining ring 80 secured to the housing 72. In operation, a bottom surface 82 of the retaining ring 80 contacts the polishing surface 36. Optionally, a plurality of channels can be formed in the bottom surface 82 of the retaining ring 80 to permit the polishing liquid 66 to flow between the inside and outside of the retaining ring 80. The lower surface of the flexible membrane 74 provides a mounting surface for a substrate 10. The housing 72 can generally be circular in shape and can be connected to the drive shaft 58 to rotate therewith during polishing. There may be passages (not illustrated) extending through the housing 72 for pneumatic control of the carrier head 70.

Figure 2A:
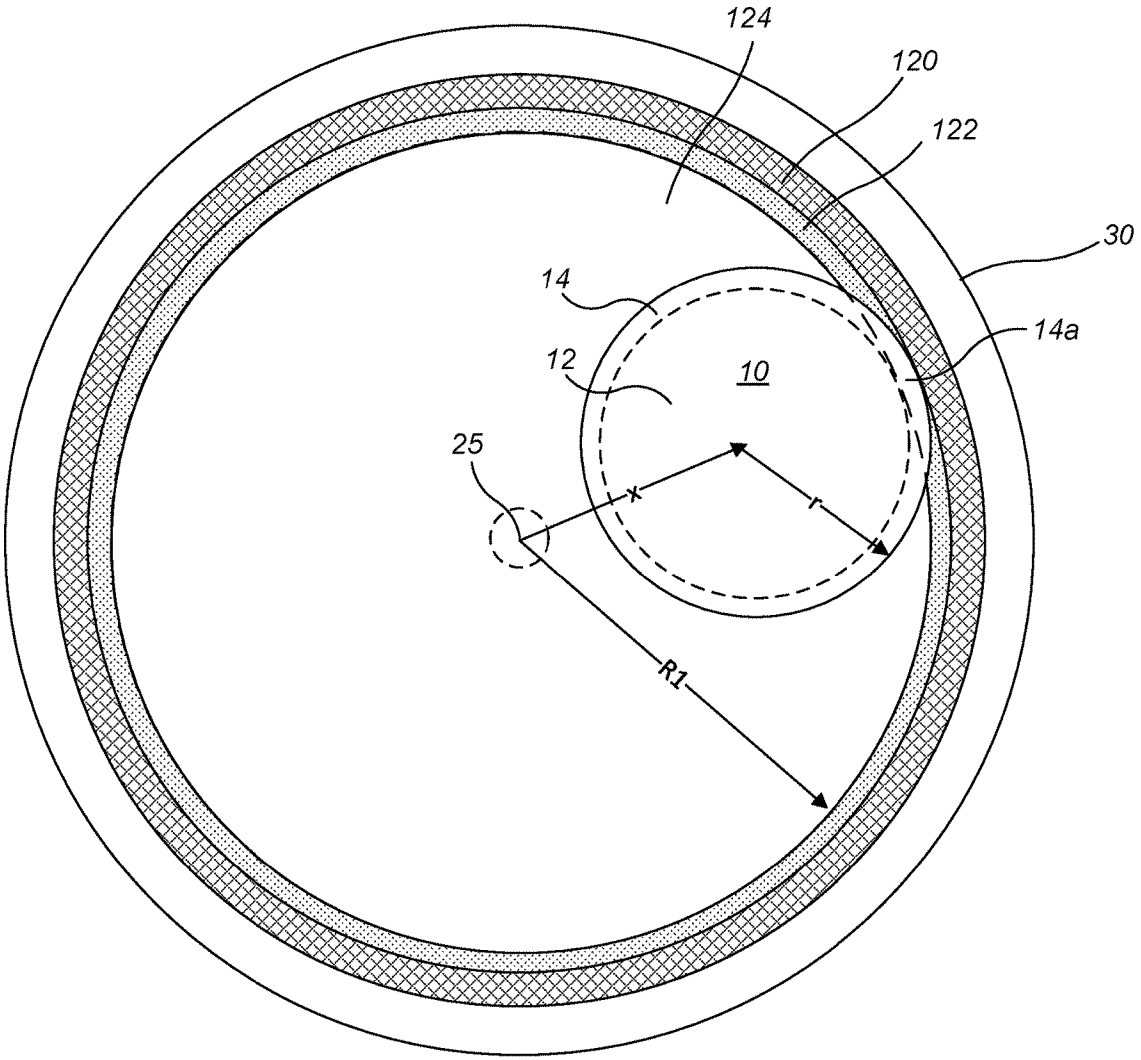
FIG. 2A is a schematic top view of a polishing pad having a polishing rate adjustment groove that is concentric with the axis of rotation.
Figure 2B:
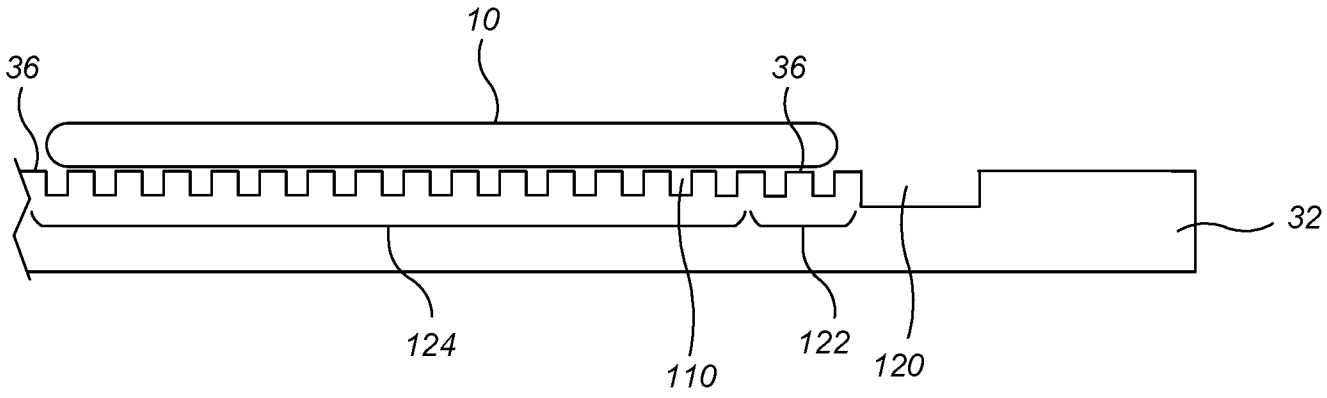
FIG. 2B is a schematic cross-sectional view of a portion of the polishing pad of FIG. 2A having both slurry-supply grooves and the polishing rate adjustment groove.

FIGS. 1, 2A, and 2B illustrate an embodiment in which the polishing pad 30 has at least one, e.g., exactly one, polishing-rate adjustment groove 120 formed in the polishing surface 36. The polishing rate adjustment groove 120 is a recessed area of the polishing pad 30. The polishing rate adjustment groove 120 can be an annular groove, e.g., circular, and can be concentric with the axis of rotation 25. The polishing rate adjustment groove 120 can surround the polishing liquid distribution grooves 110 (the polishing liquid distribution grooves 110 are not shown in FIG. 2A for ease of illustration, but are shown in FIG. 2B). Assuming the polishing liquid distribution grooves 110 are circular grooves, then the polishing rate adjustment groove 120 can be concentric with the polishing liquid distribution grooves 110. In some implementations, there are no further polishing liquid distribution grooves 110 radially outward of the polishing rate adjustment groove 120.

The walls of the polishing-rate adjustment groove 120 are perpendicular to the polishing surface 36. The bottom surface of the polishing-rate adjustment groove 120 is parallel with the polishing surface 36, although in some implementations the bottom surface of the polishing-rate adjustment groove 120 can be angled or a U-shape. The polishing-rate adjustment groove 120 can be 10 to 80 mils, e.g., 10 to 60 mils, deep. The polishing-rate adjustment groove 120 can have a width of three to fifty, e.g., five to fifty, e.g., three to ten, e.g., ten to twenty, millimeters.

In some implementations, the polishing-rate adjustment groove 120 is located near the outer edge of the polishing pad 30, e.g., within 15%, e.g., with 10% (by radius) of the outer edge. For example, the polishing-rate adjustment groove 120 can be located at a radial distance of fourteen inches from the center of a platen having a thirty inch diameter.

The polishing liquid distribution grooves 110 are narrower than the polishing-rate adjustment groove 120. For example, the polishing liquid distribution grooves 110 can be narrower by a factor of at least 3, e.g., at least 6, such as 6 to 10. The polishing-rate adjustment groove 120 can have a smaller, similar, or greater depth than the polishing liquid distribution grooves 110. In some implementations, the polishing-rate adjustment groove 120 is the only groove on the polishing pad 30 wider than the polishing liquid distribution grooves 110.

Referring to FIG. 1, in embodiments that include the polishing-rate adjustment groove 120, the polishing system 20 includes a dispenser 130 with an outlet 132 to deliver either a liquid 134 that serves as a coolant, or a dilutant, or both (see FIG. 1). In particular, the outlet 132 can be positioned directly over the polishing rate adjustment groove 120 so that the liquid 134 flows directly into the over the polishing rate adjustment groove 120. Alternatively, the outlet 132 can be positioned so that the liquid 134 flows onto the polishing surface. For example, the outlet 132 can be positioned so that the liquid 134 is dispensed at a position radially inward but near the polishing rate adjustment groove 120, e.g., within 10 cm, e.g., within 5 cm.

Assuming the liquid 134 is a coolant, the liquid coolant could be the polishing liquid 66, but chilled, e.g., to 0 to 5° C. Alternatively, the liquid coolant could be deionized (DI) water; in this case the liquid serves as both a coolant and a dilutant. In either case, the liquid coolant can be sprayed, e.g., aerosolized, by a nozzle that provides the outlet 132.

Assuming the liquid 134 is a dilutant, the liquid dilutant could be deionized (DI) water. In this case, the liquid dilutant can be distributed at room temperature, e.g., 20 to 23° C.

Referring to FIG. 2A, the distribution of the coolant and/or dilutant into the polishing-rate adjustment groove 120 generates an annular region 122 radially inward and immediately adjacent the polishing-rate adjustment groove 120 in which the polishing rate of is materially reduced (but not eliminated completely). The annular region 122 can have a width of 2 to 10 mm. Without being limited to any particular theory, some coolant and/or dilutant liquid 134 can overflow the polishing-rate adjustment groove 120 but centrifugal force may limit the inward spread of the coolant and/or dilutant liquid 134 from the polishing-rate adjustment groove 120. Still without being limited to any particular theory, if the coolant and/or dilutant liquid 134 is dispensed at a position radially inward of the polishing-rate adjustment groove 120, then the liquid can contact the substrate edge area before falling into the groove 120.

Where the liquid 134 is a coolant, the temperature of the polishing pad and polishing liquid in the annular region 122 can be reduced, thereby reducing the polishing rate as compared to a central region 124 that is radially inward of the annular region 122.

Where the liquid 134 is a dilutant, the concentration of the polishing liquid (e.g., concentration of chemistry and/or abrasive particles) in the annular region 122 can be reduced, thereby reducing the polishing rate.

When the substrate 10 is positioned over the central region 124 of the polishing pad 30, the polishing surface 36 contacts and polishes the substrate 10, and material removal takes place. On the other hand, when an edge of the substrate 10 is positioned over the annular region 122, the polishing rate of the portion of the substrate over the annular region 122 is lower than the polishing rate of the portion of the substrate over the central region 124.

Figure 3:
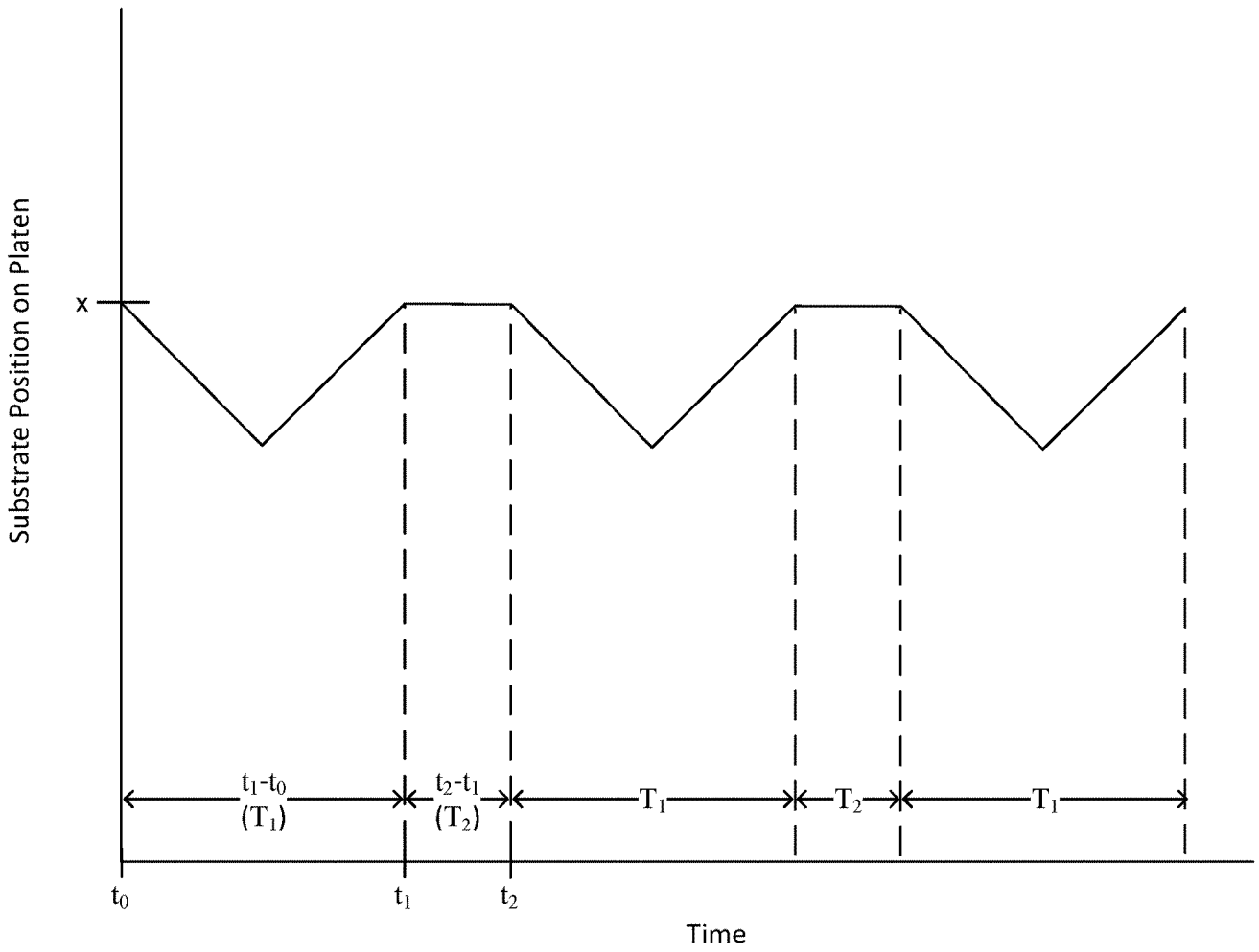
FIG. 3 is an exemplary graph of substrate position on platen versus time.

Referring now to FIGS. 2A and 3, for a first duration, the substrate 10 can be positioned in a first position or first range of positions such that the central portion 12 of the substrate 10 and the edge portion 14 of the substrate 10 are both polished by the central region 124 and the polishing surface 36 of the polishing pad 30. As such, none of the substrate 10 overlaps the annular region 122.

For a second duration, the substrate 10 can be positioned such that the central portion 12 of the substrate 10 is polished by the central region 124 and an arcuate crescent-shaped region 14*a* of the edge portion 14 of the substrate 10 is above the annular region 122. During the second duration, the substrate 10 can be held laterally fixed in a second position. Thus the central portion 12 of the substrate 10 is polished during the second duration, whereas a region 14*a* of the edge portion 14 of the substrate 10, positioned above the annular region 122, is polished at a relatively lower polishing rate. Due to rotation of the substrate 10, the edge portion 14 should still be polished in an angularly uniform manner, but at a lower average rate than the central portion 12 due to the lower polishing rate in region 14*a*. A controller can cause the support to move the carrier head 70 to oscillate the substrate 10 laterally during the first duration, and to hold the substrate 10 at a fixed position laterally for a time at the second duration.

To reduce the removal of the edge portion 14 of the substrate 10, and to obtain a more uniformly polished substrate 10, a reduce-polishing area time share can be determined. For example, equation [1] can be used to determine the non-polishing area time share $S_1$:

$$S_1 = \frac{\alpha}{180} \quad [1]$$

where $\alpha$ is the angle subtended across the substrate 10 by the annular region 122 relative to the center of the substrate, and can be determined using equations [2]-[3]:

$$\cos\alpha = \frac{R1^2 - r^2 - x^2}{2xr} \quad [2]$$

and $$\alpha = \cos^{-1}\frac{R1^2 - r^2 - x^2}{2xr} \quad [3]$$

and where R1 is the radius of the inner edge of the annular region 122, r is the radius of the substrate 10, and x is the distance from the center of the polishing pad 30 to the center of the substrate 10.

The central portion 12 of the substrate 10 and the edge portion 14 of the substrate 10 is positioned over the central region 124 for a first duration $T_1$ ($t_0$ to $t_1$). The substrate can be moved laterally in an oscillatory manner during this first duration. At the end of the first duration, the substrate is repositioned. The central portion 12 of the substrate 10 is positioned over the central region 124 and the edge portion 14 of the substrate 10 is positioned and held over the annular region 122 for a second duration $T_2$ ($t_1$ to $t_2$).

The process can be repeated so the substrate 10 oscillates between a first position—where the central portion and the edge portion of the substrate 10 is polished—for the first duration and a second position at the second duration, where the substrate is held at the second position—where the central portion of the substrate 10 is polished and the edge portion of the substrate 10 is polished at a reduced rate—for a duration calculated using the time share S.

The ratio of the first duration $T_1$ to the second duration $T_2$ can be selected so as to reduce the polishing rate of the edge portion 14 by a desired amount. For example the ratio $T_1/T_2$, can be selected to achieve a desired polishing rate at the edge, e.g., to achieve the same polishing rate as the center portion 12.

The ratio $T_2/(T_1+T_2)$ provides a percentage of time per cycle where the substrate, e.g., the edge portion 14, is positioned and held over the polishing rate adjustment groove 120 (also known as the dwell time), where a cycle is determined by the amount of time it takes for a substrate to return to the same position during one oscillation.

In general, if P is the polishing rate of the edge portion 14 without using the polishing-rate adjustment groove, P' is the polishing rate of the edge portion 14 using the polishing-rate adjustment groove, and $P_{DES}$ is the desired polishing rate, then the ratio $T_2/(T_1+T_2)$ can be set as follows:

$$P_{DES} = P\left[1 - S_1\left(\frac{T_2}{T_1 + T_2}\right)\right] + P'S_1\left(\frac{T_2}{T_1 + T_2}\right) \quad [4]$$

Figure 4A:
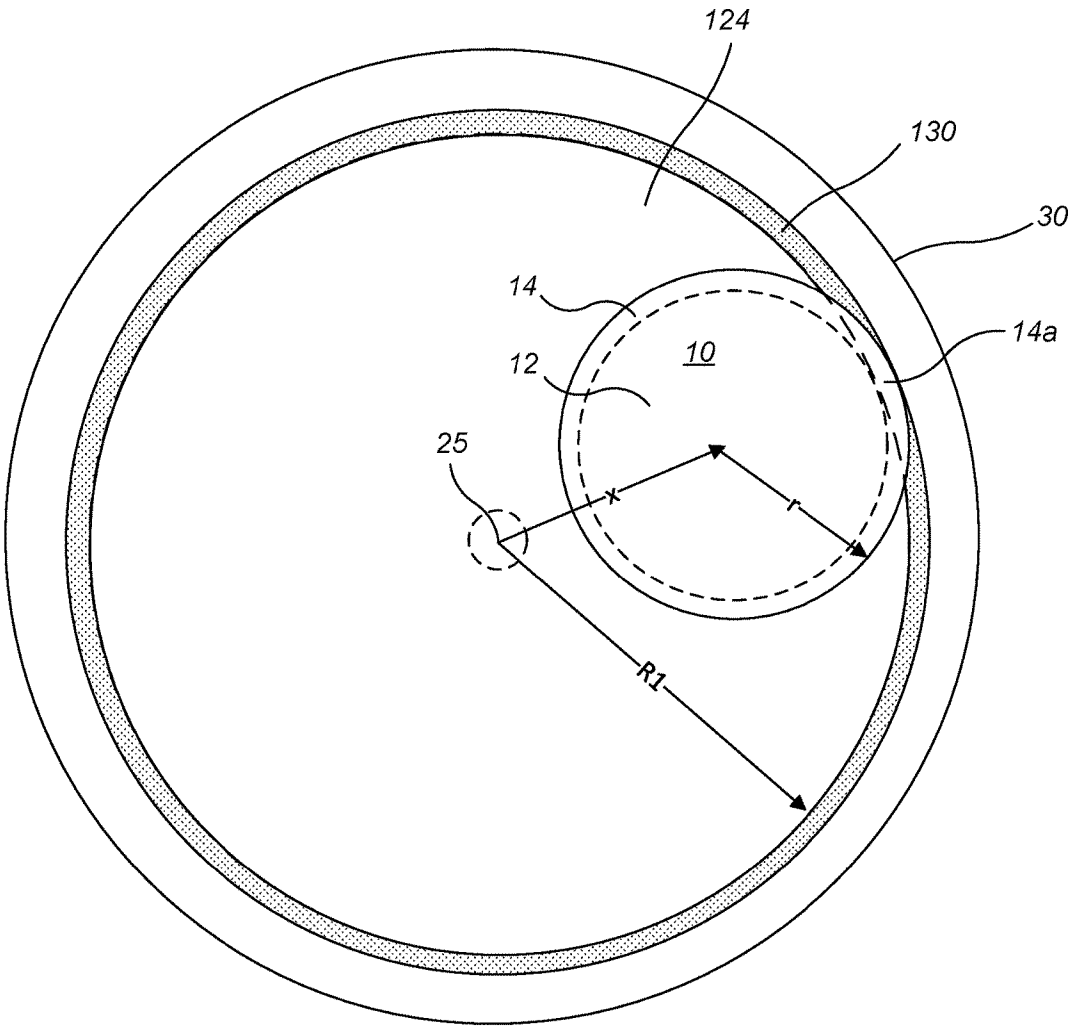
FIG. 4A is a schematic top view of another implementation of a polishing pad having an inset buff pad region.
Figure 4B:
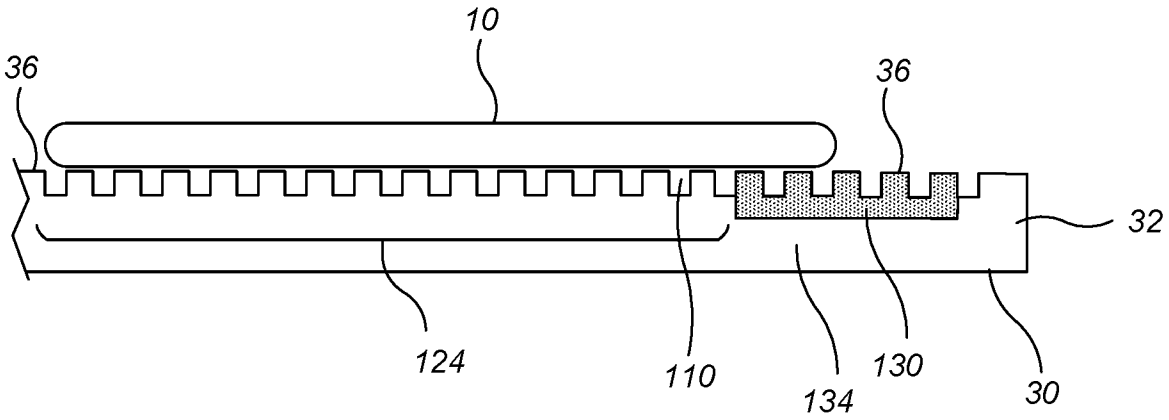
FIG. 4B is a schematic cross-sectional view of the polishing pad of FIG. 3A.

FIGS. 4A and 4B illustrate an embodiment in which an annular portion 130 of the polishing pad 30 has been replaced with a polishing material that is softer than the polishing material of the central region 124. For example, the annular portion 130 can be a poromeric polymer, e.g., promeric polyurethane. For example, the annular portion 130 can be a Suba IV or Politex polishing material. In some implementations, the annular portion 130 can have the same material composition as the central region 124, but have a higher porosity, i.e., larger and more dense pores, so as to provide a softer layer. As a result, the polishing rate of the annular portion 130 should be lower than the polishing rate that would otherwise occur if the same polishing material was present. The annular portion 130 can have the same grooving pattern as the central region 124, and can grooves and plateaus that provide a portion of the polishing surface 36.

As a result, when a crescent-shaped portion 14*a* of the edge region 14 of the substrate 10 is positioned over the annular portion 130, the polishing rate of the edge region 14 should be reduced (compared to what would otherwise occur if the same polishing material was used across the entire polishing pad).

The first polishing material, in the central region 124, can have a hardness of 50-80 Shore D. For example, the first polishing material can include a polyurethane, e.g., a porous polyurethane, e.g., polyurethane with embedded hollow microspheres. The second polishing material, in the annular portion 130, can have a hardness of 20 to 50 Shore D. The polishing surface of the central region 124 and the polishing surface of the annular portion 130 are coplanar.

As shown in FIG. 4B, the annular portion 130 formed of the second polishing material can extend partially through the polishing layer 32. In this case, the annular portion 130 is supported on a thin section 134 that is formed of the first polishing material from the central region 124. Alternatively, the annular portion 130 and second polishing material can extend entirely through the polishing layer 32.

The embodiment of FIGS. 4A and 4B can operate in a similar manner as discussed above for FIGS. 2A and 2B. That is, for a first duration, the substrate 10 can positioned in a first position or first range of positions such that the central portion 12 of the substrate 10 and the edge portion 14 of the substrate 10 are both polished by the central region 124 and the polishing surface 36 of the polishing pad 30. For a second duration, the substrate 10 can be positioned such that the central portion 12 of the substrate 10 is polished by the central region 124 and an arcuate crescent-shaped region 14*a* of the edge portion 14 of the substrate 10 is above the annular portion 130. Determination of the ratio of the first duration $T_1$ to the second duration $T_2$ can be also determined in a similar manner to that discussed above.

Figure 5A:
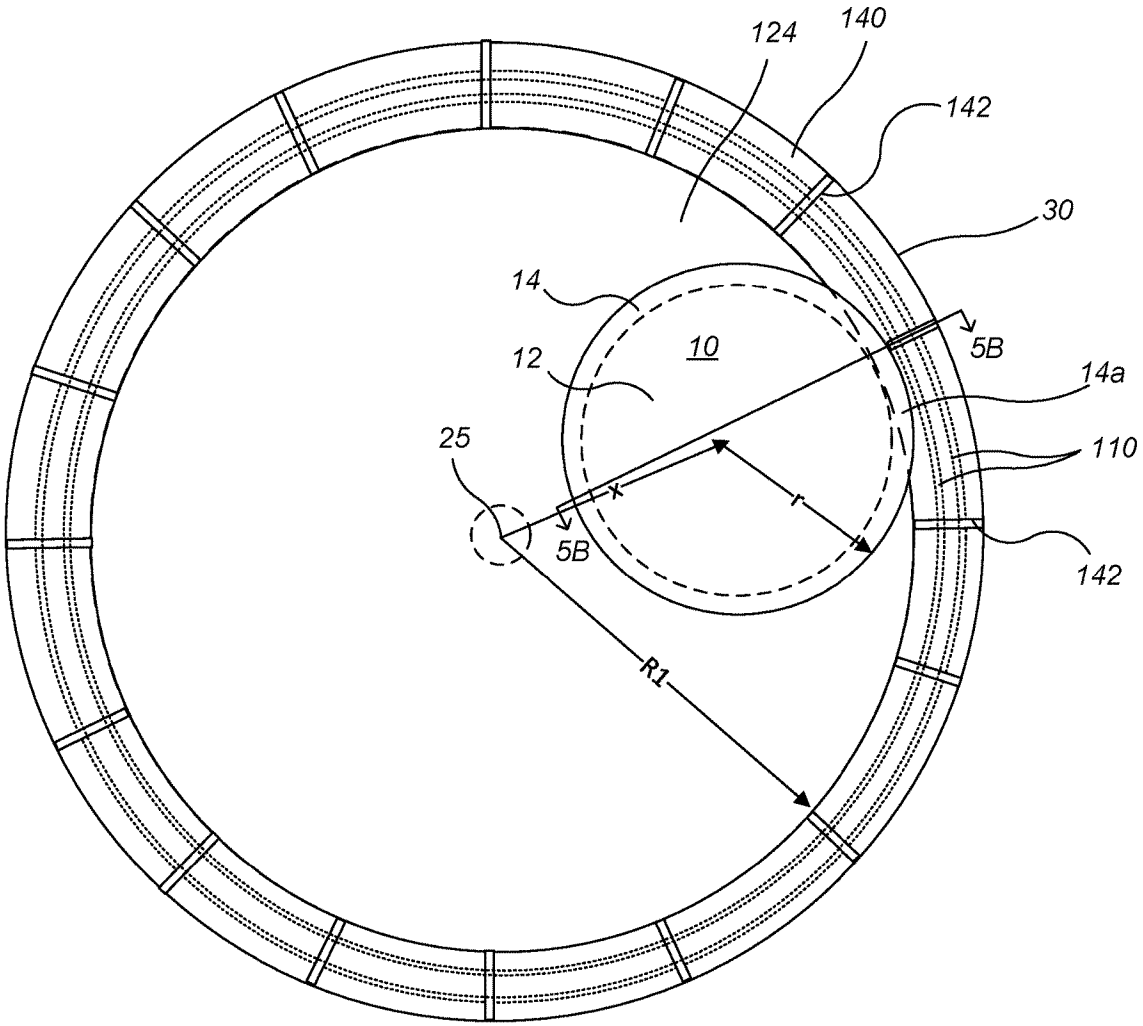
FIG. 5A is a schematic top view of another implementation of a polishing pad having radial grooves.
Figure 5B:
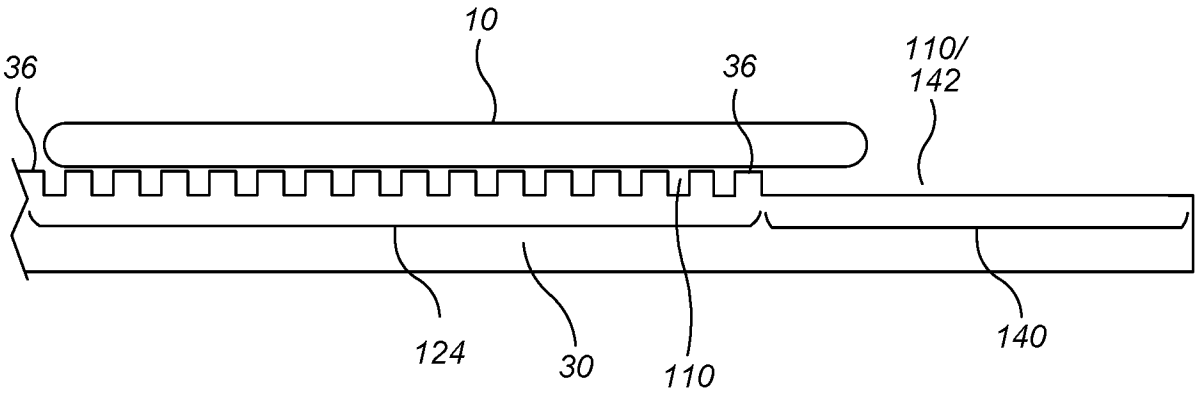
FIG. 5B is a schematic cross-sectional view of the polishing pad of FIG. 3A.

FIGS. 5A and 5B illustrate an embodiment in which an annular outer region 140 of the polishing pad 30 includes both circular polishing liquid distribution grooves 110 and radially extending polishing liquid discharge grooves 142. The radially extending polishing liquid discharge grooves 142 act to increase the flow of the polishing liquid out of the annular out region 140. As less polishing liquid is retained in the annular outer region 140, the polishing rate of the annular outer region 140 should be lower than the polishing rate that would otherwise occur if the liquid discharge grooves 142 were not present.

The polishing liquid discharge grooves 142 can be distributed at equal angular intervals around the center of the polishing pad 30, e.g., around the axis of rotation 25. The polishing liquid discharge grooves 142 can be wider and/or deeper than the polishing liquid distribution grooves 110. For example, the polishing liquid discharge grooves 142 can have a width of 1 to 5 mm.

The embodiment of FIGS. 5A and 5B can operate in a similar manner as discussed above for FIGS. 2A and 2B and 4A and 4B. That is, for a first duration, the substrate 10 can positioned in a first position or first range of positions such that the central portion 12 of the substrate 10 and the edge portion 14 of the substrate 10 are both polished by the central region 124 and the polishing surface 36 of the polishing pad 30. For a second duration, the substrate 10 can be positioned such that the central portion 12 of the substrate 10 is polished by the central region 124 and an arcuate crescent-shaped region 14*a* of the edge portion 14 of the substrate 10 is above the annular outer region 140 that has the polishing liquid discharge grooves 142. Determination of the ratio of the first duration $T_1$ to the second duration $T_2$ can be also determined in a similar manner to that discussed above.

Figure 6:
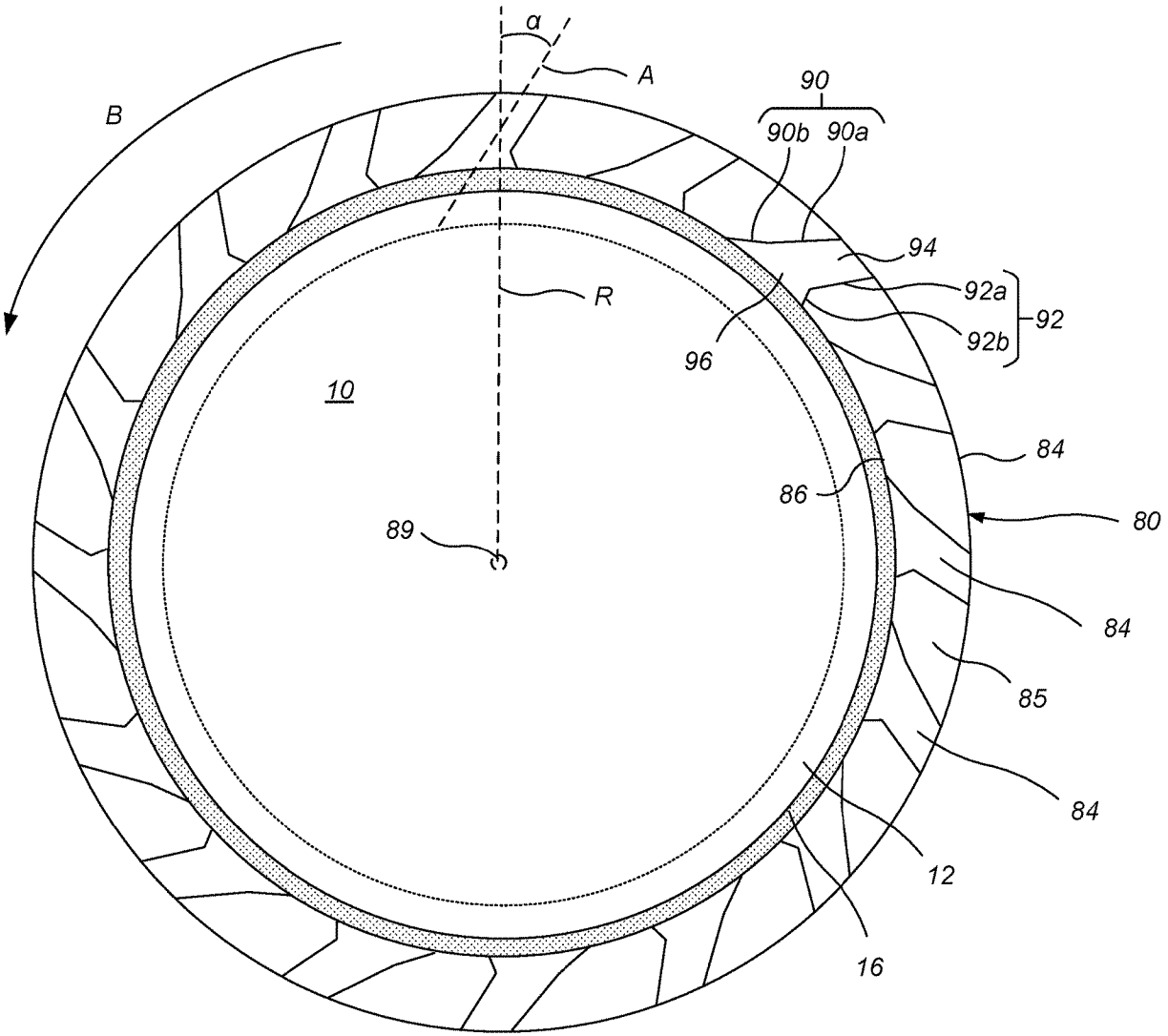
FIG. 6 is a bottom view of a retaining ring.

Yet another technique, that can be used in conjunction with any of the prior embodiments of FIG. 2A-2B, 4A-4B, or 5A-5B, is to use a retaining ring with a high density of polishing liquid channels. FIG. 6 is a view of a bottom surface 82 of the retaining ring 80 surrounding a substrate 10. A plurality of channels 84 are formed as recesses into the bottom surface 82, extending from an inner diameter surface 86 to an outer diameter surface 88 of the retaining ring 80. The channels 84 can be distributed at substantially equal angular intervals around the center 89 of the retaining ring 80. All of the channels 84 can have identical shape, albeit rotated as appropriate.

The channels 84 are configured such that the polishing liquid can easily between the inner diameter surface 86 and the outer diameter surface 88. For example, the channels 84 can be sufficiently wide that the channels 84 in a plan view occupy at least half of the surface area of the bottom surface 82, e.g., 50-75%. The large area of the channels 84 can enable slurry to easily flow away from the substrate edge 16, thus lowering the polishing rate at the edge region 12.

Moreover, the channels 84 can be configured to preferentially guide the polishing liquid from the inside of the retaining ring 80 to the outside of the retaining ring 80 and away from the substrate edge 16, as compared to channeling the polishing liquid from the outside of the retaining ring 80 toward the inside of the retaining ring 80.

For example, the channels 84 can be wider at the inner diameter surface 86 than the outer diameter surface 88. In particular, the channels 84 can be flared at the inner diameter surface 86.

As another example, the channels 84 can be canted such that the primary axis (shown by phantom line A) of each channel 84 is at oblique angle $\alpha$, e.g., 20-45°, relative to the radial segment (shown by phantom line R) extending from the center 89 of the retaining ring 80 to the respective channel 84. In particular, the channels 84 are canted from the inner diameter 86 to the outer diameter 84 in a direction opposite that of the direction of rotation (shown by arrow B). For example, if the retaining ring 80 is to rotate counter-clockwise during the polishing operation, then from the inner diameter 86 to the outer diameter 84 the channel extends clockwise. Conversely, if the retaining ring 80 is to rotate clockwise during the polishing operation, then from the inner diameter 86 to the outer diameter 84 the channel extends counter-clockwise.

Each channel 84 includes a leading edge 90 and a trailing edge 92. Without being limited to any particular theory, the rotation of the retaining ring 80 causes the trailing edge 92 of the channel (which corresponds to a leading edge of a plateau 85 between the channels) to engage the polishing liquid, and the canted angle of the trailing edge 92 urges the polishing liquid outwardly.

In the example shown in FIG. 6, The leading edge 90 includes an outer linear portion 90*a* adjacent the outer diameter surface 84. Similarly, the trailing edge 92 includes an outer linear portion 92*a* adjacent the outer diameter surface 84 . . . . In this example, the linear portions 90*a*, 92*a* are angled to form a portion 94 of the channel that narrows gradually from inside out. The linear portions 90*a*, 92*a* can an angle of 5-25°. However, in some implementations, the linear portions 90*a*, 92*a* are parallel.

The leading edge 90 also includes a portion 90*b* adjacent the inner diameter surface 84 that can be linear or curved, but which forms a larger angle with the radial segment R than the outer linear portion 90*a*. Similarly, the trailing edge 92 also includes a portion 92*b* adjacent the inner diameter surface 84 that can be linear or curved, but which forms a smaller angle with the radial segment R than the outer linear portion 92*a*. The configuration can create a flared opening portion 96 at the inner diameter surface 86, which widens more quickly (from outside in) than the portion 94.

Any of these effects tends to urge the polishing liquid to flow away from the substrate edge 16, thus lowering the polishing rate at the edge region 12.

As used in the instant specification, the term substrate can include, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

The above described polishing system and methods can be applied in a variety of polishing systems. Either the polishing pad, or the carrier head, or both can move to provide relative motion between the polishing surface and the substrate. The polishing pad can be a circular (or some other shape) pad secured to the platen. The polishing layer can be a standard (for example, polyurethane with or without fillers) polishing material, a soft material, or a fixed-abrasive material. Terms of relative positioning are used; it should be understood that the polishing surface and substrate can be held in a vertical orientation or some other orientation.

Particular embodiments of the invention have been described. Other embodiments are within the scope of the following claims. For example, the actions recited in the claims can be performed in a different order and still achieve desirable results.

What is claimed is:

1. A method for chemical mechanical polishing, the method comprising:

rotating a polishing pad about an axis of rotation;

positioning a substrate against the polishing pad, the polishing pad having a polishing-rate adjustment groove that is concentric with the axis of rotation;

dispensing a polishing liquid onto the polishing pad;

dispensing a coolant, a dilutant, or both, directly into the polishing-rate adjustment groove such that a polishing rate is reduced in an annular zone of the polishing pad that is positioned radially inward of the polishing-rate adjustment groove, and wherein the annular zone surrounds a central zone of the polishing pad in which a polishing rate is not substantially affected by the coolant, dilutant, or both; and oscillating the substrate laterally across the polishing pad such that for a first duration a central portion of the substrate and an edge portion of the substrate are positioned over the central zone of the polishing pad such that the central portion of the substrate and the edge portion of the substrate are polished for the first duration by the central zone of the polishing pad, and for a second duration holding the central portion of the substrate is positioned over the central zone of the polishing pad and an angularly extending section of the edge portion of the substrate is positioned over the annular zone such that the central portion of the substrate is polished for the second duration by the central zone of the polishing pad and the edge portion of the substrate is polished for the second duration by both the central zone of the polishing pad and the annular zone so as to reduce a polishing rate of the edge portion.

2. The method of claim 1, wherein dispensing the coolant, the dilutant, or both comprises dispensing the coolant.

3. The method of claim 2, wherein the coolant comprises chilled polishing liquid.

4. The method of claim 2, wherein the coolant is purified deionized water.

5. The method of claim 1, wherein dispensing the coolant, the dilutant, or both comprises dispensing the dilutant.

6. The method of claim 5, wherein the dilutant is purified deionized water.

7. The method of claim 1, comprising holding the substrate in a laterally fixed position for the second duration.

8. The method of claim 1, wherein the polishing pad further comprises polishing liquid distribution grooves.

9. The method of claim 8, wherein the polishing liquid distribution grooves are concentric with the polishing-rate adjustment groove.

10. The method of claim 8, wherein the polishing liquid distribution grooves are narrower than the polishing-rate adjustment groove.

11. The method of claim 1, wherein the polishing pad has a single polishing-rate adjustment groove.

12. A polishing system, comprising:

a rotatable platen to support a polishing pad that has a polishing-rate adjustment groove that is concentric with an axis of rotation of the platen;

a first dispenser to deliver a polishing liquid onto the polishing pad;

a second dispenser to deliver a coolant, a dilutant, or both, directly into the polishing-rate adjustment groove such that a polishing rate is reduced in an annular zone of the polishing pad that is positioned radially inward of the polishing-rate adjustment groove, and wherein the annular zone surrounds a central zone of the polishing pad in which a polishing rate is not substantially affected by the coolant, dilutant, or both;

a carrier head to hold a substrate against the polishing pad, the carrier head laterally movable across the polishing pad;

an actuator to move the carrier head; and a controller coupled to the actuator and configured to cause the actuator to oscillate the carrier head and substrate laterally across the polishing pad such that for a first duration cause the actuator to position a central portion of the substrate and an edge portion of the substrate over the central zone of the polishing pad such that the central portion of the substrate and the edge portion of the substrate are polished for the first duration by the central zone of the polishing pad, and for a second duration cause the actuator to position the central portion of the substrate over the central zone of the polishing pad and an angularly extending section of the edge portion of the substrate over the annular zone such that the central portion of the substrate is polished for the second duration by the central zone of the polishing pad and the edge portion of the substrate is polished for the second duration by both the central zone of the polishing pad and the annular zone so as to reduce a polishing rate of the edge portion.

13. The system of claim 12, wherein the controller is configured to cause the actuator to hold the substrate in a laterally fixed position for the second duration.

14. The system of claim 12, wherein the second dispenser is configured to dispense the coolant.

15. The system of claim 13, wherein the coolant comprises chilled polishing liquid.

16. The system of claim 13, wherein the coolant is purified deionized water.

17. The system of claim 12, wherein the second dispenser is configured to dispense the dilutant.

18. The system of claim 17, wherein the dilutant is purified deionized water.

* * * * *